United States Patent [19]

Estwanik, III

[11] 4,411,423

[45] Oct. 25, 1983

[54] EXERCISE DEVICE AND EXERCISE ADAPTER FOR FORMING SAME

[76] Inventor: Joseph J. Estwanik, III, 1925 Clematis Dr., Charlotte, N.C. 28211

[21] Appl. No.: 363,036

[22] Filed: Mar. 29, 1982

[51] Int. Cl.[3] ..... A63B 21/00

[52] U.S. Cl. ..... 272/117

[58] Field of Search ..... 273/29 A, 29 R, 54 BA, 273/73 R, 190 A, DIG. 19; 272/67, 68, 93, 94, 117, 122, 143, 116

[56] References Cited

U.S. PATENT DOCUMENTS

| | | | |
|---|---|---|---|
| 2,475,656 | 7/1949 | Bidak | 272/117 X |
| 3,109,654 | 11/1963 | Comitz | 273/190 A X |
| 3,269,729 | 8/1966 | Morrison | 273/54 BA |
| 3,806,121 | 4/1974 | Crossley | 272/67 X |
| 3,858,881 | 1/1975 | Hurwitz | 273/29 R X |
| 3,982,755 | 9/1976 | Sarich | 272/117 |
| 4,121,822 | 10/1978 | DiSabatino et al. | 273/DIG. 19 |
| 4,168,060 | 9/1979 | Hohenfeldt | 272/67 |
| 4,229,002 | 10/1980 | Masters | 272/67 |

FOREIGN PATENT DOCUMENTS

| | | | |
|---|---|---|---|
| 2281038 | 3/1976 | France | 273/29 A |

*Primary Examiner*—Richard J. Apley

*Attorney, Agent, or Firm*—Bell, Seltzer, Park & Gibson

[57] ABSTRACT

A portable, lightweight exercise adapter is provided for forming an exercise device therefrom by securement of the adapter to any suitable handle and weight. One end of the adapter is provided with a flexible band adapted for releasable securement around the handle, and the other end is provided with means for releasably attaching any suitable weight thereto so that, by grasping the handle in the hands of a user and rotating and/or lifting the handle, the weight may be raised and lowered for exercising of the user's upper extremities.

5 Claims, 6 Drawing Figures

EXERCISE DEVICE AND EXERCISE ADAPTER FOR FORMING SAME

FIELD AND BACKGROUND OF THE INVENTION

The present invention relates to an exercise device for a person's upper extremities and maladies thereof such as "tennis elbow," and more particularly to an adapter from which the exercise device is readily formed by attachment of a suitable weight to one end of the adapter and securement of the other end of the adapter around a handle such as the handle of a tennis racket, a baseball bat or any suitable rod. In exercise devices of this type, usually the user grasps the handle with both hands to rotate the handle and to cause the weight to be raised and lowered by the user. Additionally, the user may raise and lower the weight with or without rotating the handle.

While various types of exercise devices have been utilized for exercising a person's upper extremities, these devices have been specially constructed such that the handle and usually the weight are integral parts of the unit. In this regard, see U.S. Pat. Nos. 2,475,656 and 3,806,121. As will be apparent from the disclosures of these patents, these devices are bulky and cumbersome and are not easily stored when the devices are not in use.

SUMMARY OF THE INVENTION

With the foregoing in mind, it is a primary object of this invention to provide an exercise adapter and an exercise device formed therefrom, and wherein the exercise adapter is so constructed as to be used with a variety of weights and handles in forming the exercise device therefrom, most anywhere, by utilizing for the weight and handle, any convenient and readily available weight or handle.

A further object of the invention is to provide a readily portable, lightweight exercise adapter which may be easily folded, stored and transported in a compact state, as in one's pocket, while not in use.

In accordance with this invention, an exercise adapter including a flexible elongate member is provided for forming an exercise device therefrom wherein the exercise adapter is so constructed to facilitate securement of the adapter to any suitable handle, such as the handle of a tennis racket or the like. To this end, one end of the exercise adapter is provided with a flexible band for readily being positioned around a tennis racket handle with means carried thereon for releasably securing the adapter around the handle. For facilitating connection of the exercise adapter to any suitable weight, a snap hook and an adjustable loop are provided on the other end of the exercise adapter. The adjustable loop facilitates attachment to any weight, such as an athletic bag, in which the bag and its contents serve as the weight, or a barbell weight.

BRIEF DESCRIPTION OF THE DRAWINGS

Some of the objects and advantages of the invention having been stated, others will appear as the description proceeds, when taken in connection with the accompanying drawings, in which.

DETAILED DESCRIPTION

While the present invention will be described hereinafter with particular reference to the accompanying drawings, in which an illustrative embodiment of the present invention is set forth, it is to be understood at the outset of the description which follows that it is contemplated that persons skilled in the applicable arts may modify the specific details to be described while continuing to use this invention. Accordingly, the description is to be understood as a broad teaching of this invention, directed to persons skilled in the applicable arts.

Figure 1:
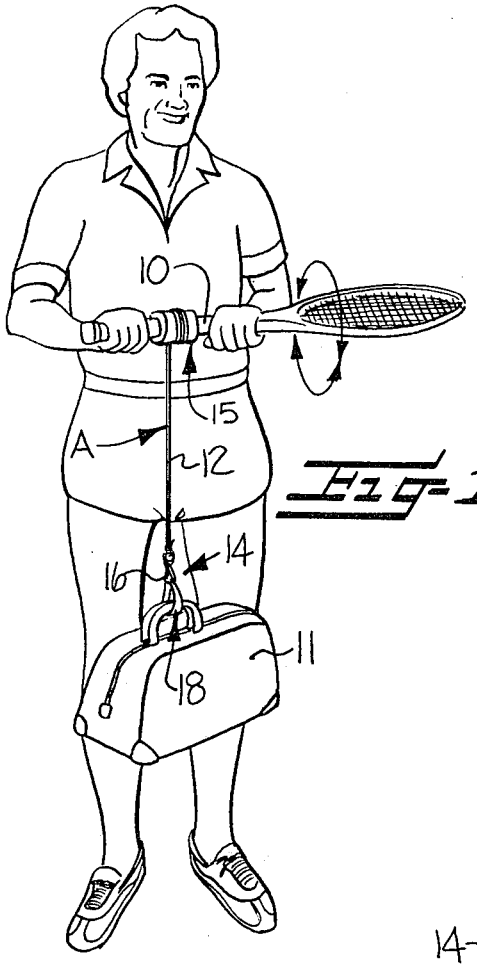
FIG. 1 is a perspective view of the upper extremity exercise device in use, and particularly illustrating how the exercise device is readily constructed by connecting the adapter thereof to a suitable handle and weight.

Referring more specifically to the drawings, the exercise device of this invention is illustrated in FIG. 1 as in use by a person in exercising one's upper extremities. Since the exercise device is especially useful in aiding to alleviate the occurrence of so-called "tennis elbow," the handle 10 of a tennis racket is shown, by way of example, serving as the handle means of the present invention.

The exercie device of this invention is formed by connecting the exercise adapter thereof, generally designated at A, to handle 10 and to any suitable and readily available weight 11. By way of example, the weight 11, as shown in FIG. 1, may take the form of an athletic bag such as is commonly carried by tennis players and other athletes and wherein the bag and its contents serve as the weight.

Upon formation of the exercise device, a person may use the device to exercise the upper extremities by placing his or her hands on the end portions of the handle 10 and rotating the handle 10 in one direction such as to thereby raise the weight 11, and rotating the handle in the opposite direction to lower the weight 11.

Figure 2:
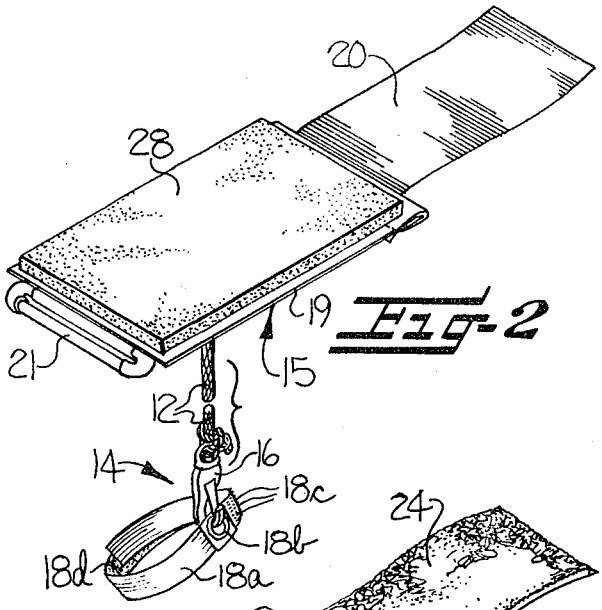
FIG. 2 is an enlarged perspective view of the inner side of the exercise adapter removed from the handle of FIG. 1 and with the weight also being removed from the exercise adapter.
Figure 3:
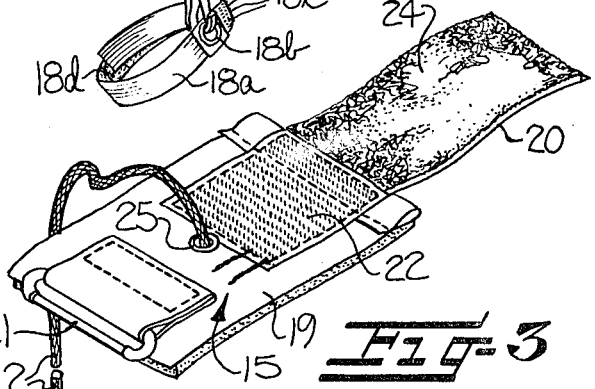
FIG. 3 is a perspective view of the exercise adapter depicting the outer side of the flexible band thereof.
Figure 5:
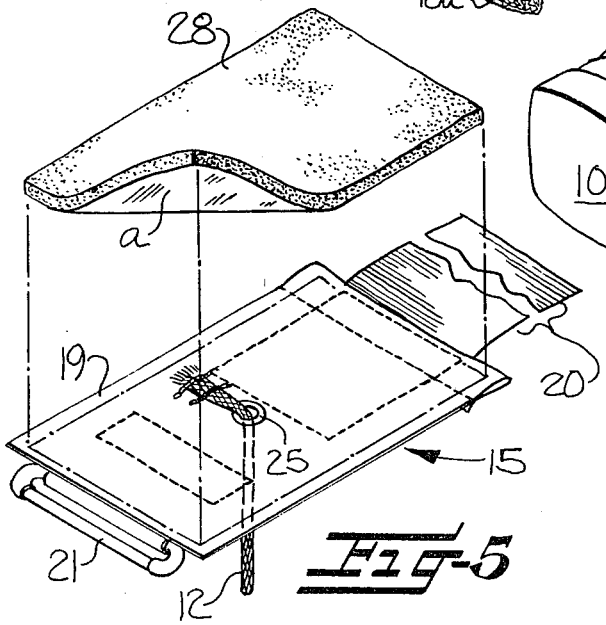
FIG. 5 is a parially exploded perspective view of the inner side of the flexible band of the exercise adapter.
Figure 6:
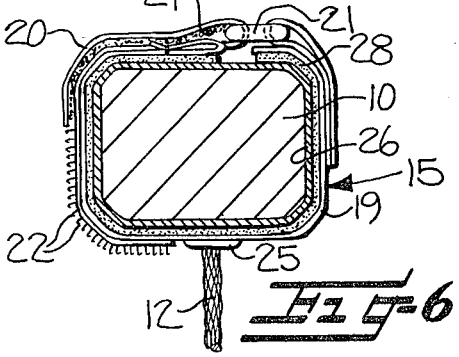
FIG. 6 is an elevational view of the flexible band in releasable securement around the circumference of the handle, but showing the handle in cross-section, and being taken along the line 6—6 of FIG. 4.

Referring particularly to FIGS. 2, 3 and 5, it will be observed that the exercise adapter A of the present invention comprises an elongate relatively narrow pliable member 12, illustrated in the drawings as a cord. A weight connecting means, broadly designated at 14, is provided for detachably connecting one end of the cord 12 to the weight 11, and a handle connecting means, broadly referred to at 15, is provided at the other end of the cord 12 for releasably securing the cord 12 to the handle 10.

The weight connecting means 14 is illustrated as a snap hook 16 and an adjustable loop 18 carried by the snap hook 16. As best shown in FIG. 3, the adjustable loop may take the form of a double-ended ribbon-like pliable element **18*a* which may be provided with any suitable means for releasably securing opposite ends thereof together. As preferred, the medial portion of the pliable element 18***a* is provided with an opening 18*b* therethrough for loosely receiving therein the hooked end of the snap hook 16, and opposite end portions of the pliable element 18*a* are provided with cooperating fastener elements, which are illustrated in the form of the hook pile elements 18*c* and the fibrous or napped pile surface 18*d* of a so-called Velcro-type fastening means, for detachably and adjustably securing the ends of the ribbon-like pliable element 18*a* in overlapping relationship for forming the loop 18 so as to facilitate attaching the loop 18 to a variety of available weights, such as the athletic bag 11. As illustrated in FIG. 1, the adjustable loop 18 is passed through the handle of the athletic bag 11 and the hook and pile portions 18*c*, 18*d* of the adjustable loop 18 are then secured in overlapping engagement thus forming the loop and allowing the weight 11 to be raised and lowered during use of the exercise device.

The means 15 for securing the cord 12 to the handle 10 is illustrated as comprising a relatively wide flexible band 19 adapted to be wrapped around the circumference of the handle 10. The flexible band 19 is releasably secured around and in surrounding relation to the circumference of the handle 10 by means of a flexible fastening member or strip 20 which is connected to and extends outwardly from one end portion of the band 19 and is adapted for passing the same through an elongate loop 21 of plastic or other substantially rigid material carried on the end portion of the flexible band 19 opposite from the fastening member 20. The fastening member 20 is preferably of a Velcro-type material with a portion of hook-shaped fiber members 22 and a portion of loose fibrous material 24. Upon passing the flexible fastening member 20 through the loop 21, the end portions of the flexible fastener 20 are secured in overlapping relationship for releasable securement of the flexible band 19 to the handle 10.

To assure initial wrapping of the cord 12 on and around the flexible band 19 during use of the exercise device, a grommet 25 is positioned in and defines an opening in the flexible band 19. Preferably, the grommet 25 is substantially centrally disposed with respect to the width of the flexible band 19. Accordingly, the initial wrappings of the cord 12 on the flexible band 19 during use aids in the further securement of the flexible band 19 to the handle by providing additional pressure of the flexible band 19 upon the circumference of the handle 10. In this regard, it will be observed in FIGS. 3 and 5 that the cord 12 extends through the grommet 25 and is suitably secured to the underside of the flexible band 19, as by stitching.

Figure 4:
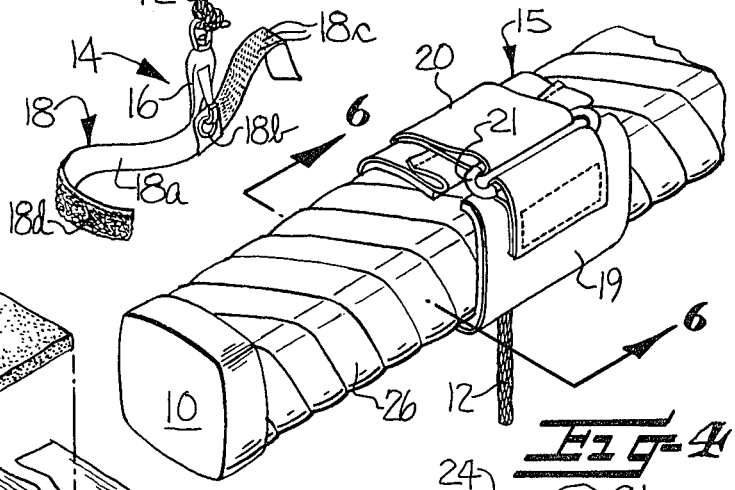
FIG. 4 is a perspective view of the flexible band of the exercise adapter in releasable securement around the circumference of a handle.

As illustrated in FIG. 4, the flexible band 19 is releasably secured around the grip 26 of the tennis racket handle 10. In order to protect the grip 26, which may be constructed of leather, padding means 28 is attached to the inner side of the flexible band 19. As illustrated in FIG. 5, the padding means 28 is attached to the inner side of the flexible band 19 by means of any suitable adhesive, such as a pressure sensitive adhesive a. Preferably, the padding means 26 is of an elastomeric foam web material which substantially covers the major portion of the surface area of the inner side of the flexible band 19. Additionally, the padding means 28 aids in the further securement of the flexible band 19 to the circumference of the handle 10, which is especially beneficial in regard to handles having a circular cross-section.

Thus, it may be seen that this invention provides an exercise adapter so constructed as to be used with a variety of weights and handles in readily making an upper extremity exercise device therefrom in most any location by utilizing any suitable and readily available weight and handle.

In the drawings and specification, there has been set forth a preferred embodiment of the invention, and although specific terms are employed, they are used in a generic and descriptive sense only and not for purposes of limitation.

What is claimed is:

1. An exercise device for use by a person in exercising of one's upper extremities, said device comprising (a) an elongate relatively narrow pliable member;

(b) handle means around which said narrow pliable member is adapted to be wound;

(c) weight means connected to one end of said elongate pliable member; and (d) means connected to the other end of said elongate pliable member and securing the same to said handle means and comprising (1) a relatively wide flexible band wrapped around the circumference of said handle means and on and around which band said narrow pliable member is wound during use of the exercise device, and (2) means carried by and cooperating with said flexible band for releasably securing the same in surrounding relation to said handle means whereby upon rotational movement of the handle means in one direction, the elongate pliable member is wound in wrapping relation on and around the flexible band in aiding in further securement of the flexible band to the handle means, and upon rotational movement of the handle means in the opposite direction the wound narrow pliable member is unwound and lowered relative to the handle means thus imparting the desired exercise to the upper extremities of the person.

2. An exercise device according to claim 1 wherein said securing means carried by said flexible band comprises at least one loop connected to said flexible band adjacent one end thereof and a flexible fastening member connected to and extending outwardly from the opposite end of the band and adapted for passing through said loop for releasable securement of said flexible band to a handle when the flexible band is wrapped therearound.

3. An exercise device according to claim 1 further comprising padding means attached to the inner side of said flexible band for protecting the surface of said handle when the flexible band is wrapped therearound.

4. An exercise device for use by a person in exercising of one's upper extremities, said device comprising:

(a) a cord;

(b) handle means around which said cord is adapted to be wound;

(c) weight means;

(d) means connected to one end of said cord for securing said weight means thereto;

(e) means connected to the other end of said cord for securing said handle means thereto for the winding of the cord therearound and comprising (1) a relatively wide flexible band adapted to be wound about the circumference of said handle means and connected to said cord;

(2) means carried by and cooperating with said flexible band for releasably maintaining the band, when placed around said handle means, in a surrounding securement thereto, and (3) a grommet positioned in an opening of said band and through which grommet said cord extends in connecting to said band, said grommet being substantially centrally disposed with respect to the width of said band so as to assure initial wrapping of the cord on and around the flexible band in aiding in securing the flexible band to said handle means.

5. A compact and easily carried exercise adapter for use with any readily available handle, such as the handle of a tennis racket, and any available weight, such as an athletic bag, for converting the exercise adapter to an upper extremity exercise device, said adapter comprising:

(a) a cord;

(b) means connected to one end of said cord for securing any available weight thereto and comprising (1) a snap hook, and (2) an adjustable loop carried by said snap hook, said adjustable loop facilitating securement to a variety of available weights;

(c) means connected to the other end of said cord for securing any available handle thereto for the winding of the cord therearound and comprising (1) a relatively wide flexible band adapted to be wrapped around the circumference of the handle and connected to said cord, (2) means carried by and cooperating with said flexible band for releasably maintaining the band, when placed around a handle, in surrounding securement thereto, said means comprising (a) at least one loop connected to said flexible band adjacent one end thereof, and (b) a flexible fastening member connected to and extending outwardly from the opposite end of the band and adapted for passing through said loop for releasable securement of said flexible band to a handle when the flexible band is wrapped therearound, and comprising (1) a plurality of hook-shaped fiber members connected to and defining a predetermined outer surface area of said flexible fastening member, and (2) a loose fibrous material connected to and defining another predetermined outer surface area of said flexible fastening member and being positioned relative to said hook-shaped fiber members so as to releasably engage the same, and (3) a grommet positioned in an opening of said band and through which grommet said cord extends in connecting to said band, said grommet being substantially centrally disposed with respect to the width of said band so as to assure initial wrapping of the cord on and around the flexible band in aiding in securing the flexible band to a handle; and (d) padding means attached to the inner side of said flexible band for protecting the surface of a handle when the flexible band is wrapped therearound.

* * * * *